US007436422B2

(12) United States Patent
Okazaki

(10) Patent No.: US 7,436,422 B2
(45) Date of Patent: Oct. 14, 2008

(54) LIGHT SOURCE MODULE, OPTICAL UNIT ARRAY AND PATTERN WRITING APPARATUS

(75) Inventor: Masahide Okazaki, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 284 days.

(21) Appl. No.: 10/936,510

(22) Filed: Sep. 9, 2004

(65) Prior Publication Data

US 2005/0057643 A1 Mar. 17, 2005

(30) Foreign Application Priority Data

Sep. 12, 2003 (JP) ..... P2003-321431
Sep. 12, 2003 (JP) ..... P2003-321432

(51) Int. Cl.
*B41J 2/45* (2006.01)

(52) U.S. Cl. ..... 347/238

(58) Field of Classification Search ..... 347/238
See application file for complete search history.

(56) References Cited

U.S. PATENT DOCUMENTS

| | | | | |
|---|---|---|---|---|
| 4,096,486 | A * | 6/1978 | Pfeifer et al. | 347/238 |
| 5,477,259 | A | 12/1995 | Iwasa | |
| 5,617,441 | A * | 4/1997 | Nakata et al. | 372/70 |
| 6,037,964 | A * | 3/2000 | Gomi et al. | 347/238 |
| 6,975,344 | B2 * | 12/2005 | Okazaki | 347/238 |
| 2003/0052960 | A1 | 3/2003 | Okazaki | |

FOREIGN PATENT DOCUMENTS

| | | |
|---|---|---|
| JP | 05-210284 | 8/1993 |
| JP | 06-47954 | 2/1994 |
| JP | 11-177181 | 7/1999 |
| JP | 2000-355009 | 12/2000 |
| JP | 2001-339122 | 12/2001 |
| JP | 2003-029180 | 1/2003 |
| JP | 2003-94716 | 4/2003 |

OTHER PUBLICATIONS

Japanese Office Action issued in Japanese Patent Application No. JP 2003-321431, issued on Jun. 17, 2008.

* cited by examiner

*Primary Examiner*—Hai C Pham
*Assistant Examiner*—Kainoa B Wright
(74) *Attorney, Agent, or Firm*—McDermott Will & Emery LLP

(57) ABSTRACT

An optical unit array comprises a plurality of optical units (2) in each of which a plurality of light source modules (1) are arranged and a first comb-teeth member (41) and a second comb-teeth member (42) which are provided for holding the optical units (2), and respective first pins (213) and second pins (214) of a plurality of optical units (2) are held by the first comb-teeth member (41) and the second comb-teeth member (42). In the optical unit array (4), positions of a plurality of optical units (2) relative to one another can be determined with high accuracy by bringing the first pins (213) and the second pins (214) into contact with grooves (411) and grooves (421), respectively. The outgoing positions and directions of light beams emitted from the light source modules (1) are also determined with high accuracy in each optical unit (2).

22 Claims, 10 Drawing Sheets

LIGHT SOURCE MODULE, OPTICAL UNIT ARRAY AND PATTERN WRITING APPARATUS

BACKGROUND OF THE INVENTION

1. Field of the Invention

The present invention relates to a light source module for emitting a light beam and a technical field to perform a beam direct-writing on e.g., a semiconductor substrate, a glass substrate, a printing plate or the like with light beams by using a plurality of light source modules.

2. Description of the Background Art

As a light source module used for beam direct-writing to a semiconductor substrate, glass substrate, a printing plate or the like, conventionally, combination of a semiconductor laser of CAN package and a collimator lens has been well known, and for example, light source modules each having a structure in which a collimator lens is provided instead of a glass window of the CAN package serving as an outlet of light beams, being attached to a member for mounting, have been used. Thus, with regard to the light source module, pins standing at the member for mounting are inserted into holes of a holder in the CAN package to make positioning of the light source module and a reference surface of the holder is brought into contact with the member for mounting to determine the direction of the light beam to be emitted.

Japanese Patent Application Laid Open Gazette No. 6-47954 (Reference Document 1) discloses a structure in which a semiconductor laser of CAN package is provided on one side of a hole formed in a light source mounting stay which is part of a light source unit and a collimator lens is disposed inside the hole. The Reference Document 1 proposes a light source unit in which a plurality of light source modules each having such a structure are arranged.

In such a light source unit having a plurality of light source modules as shown in the Reference Document 1, however, it is necessary to determine respective outgoing positions and outgoing angles of a plurality of light beams to be uniform with high accuracy. When the semiconductor laser of the CAN package is used as a light source, since the semiconductor laser is supplied with power by, e.g., directly soldering wires to electric terminals protruding from the CAN package, there is a possibility that the outgoing position and the outgoing angle of a light beam which have been already determined in this stage may shift.

There is also a possibility that due to ill effects such as oscillation and heat in use of the light source unit, the outgoing positions and the outgoing angles of light beams may change with time to cause shifts from the original positions and angles in a stage where the light source unit is manufactured.

In a pattern writing apparatus (including an image recording apparatus), conventionally, a technique to improve a writing speed by using a light source array in which light sources for emitting a plurality of light beams for writing are arranged. In a scan type image recording apparatus using a drum, for example, a high-speed image recording to a photosensitive material is achieved by rotating the drum wound with the photosensitive material at high speed while moving the light source array for emitting a plurality of light beams which is provided in a two-dimensional arrangement in a subscan direction perpendicular to a direction of rotating the drum (main scan direction).

In an optical transmission line used for optical communication, in order to connect two bundles of optical fibers to each other, a technique to collectively connect a lot of optical fibers with efficiency is used where a plurality of optical fibers are two-dimensionally arranged on and connected to connectors and the connectors are connected to one another.

On such an array structure of a plurality of optical device elements, various techniques are disclosed. Japanese Patent Application Laid Open Gazette No. 11-177181 (Reference Document 2), for example, discloses a technique to control ON/OFF and intensity of light beams from a plurality of semiconductor lasers by arranging the semiconductor lasers to be electrically insulated from one another and wired on a side opposite to laser emission surfaces.

The above-discussed Reference Document 1 discloses a technique to ensure size-reduction of a light source unit for emitting a plurality of light beams, with a simplified structure in which positioning pins standing on a base block are inserted into pin holes of a light source member having a plurality of semiconductor lasers. Japanese Patent Application Laid Open Gazette No. 2000-335009 (Reference Document 3) discloses a technique to form a two-dimensional optical element aggregate of high precision, where optical element blocks on which a plurality of light emitting diodes for emitting light beams are positioned with high accuracy are supported by comb-teeth parts of a supporting member.

As to such an array structure of a plurality of optical device elements, it is important to ensure a high-precision arrangement. If the optical device element is a light source such as a semiconductor laser, it is necessary to determine respective outgoing positions and outgoing angles of a plurality of light beams to be aligned and uniform with high accuracy.

In the light source unit of Reference Document 1, for example, though positioning of the light source member having a plurality of semiconductor lasers is determined with high accuracy by using the positioning pins and the pin holes, in the case where the light source member is made of an insulating material, processings such as wire electro-discharge machining (or etching) and the like can not be performed and this makes it hard to form the pin holes with high accuracy. Especially, it becomes hard to determine the intervals of the pin holes with high accuracy in forming a plurality of pin holes.

In the optical element aggregate of Reference Document 3, though relative positions of a plurality of optical element blocks are determined by inserting the optical element blocks into the comb-teeth parts having grooves formed with high accuracy and the outgoing positions of light beams in a direction orthogonal to an arrangement direction of the light emitting diodes are determined with high accuracy by using a rod lens, it is impossible to correct the positions of the light emitting diodes in the arrangement direction. Further, since the optical element block has a structure in which a plurality of light emitting diodes are directly mounted on one substrate, it is difficult to use a light source of less reliability, such as a semiconductor laser (which has a possibility that some deficits may be found in screening due to aging or the like).

SUMMARY OF THE INVENTION

It is an object of the present invention to determine an outgoing position and an outgoing angle of light from a light source module relative to a mounting plate with high accuracy. It is another object of the present invention to determine relative positions of a plurality of optical units with high accuracy in an optical unit array where optical device elements such a light source, lens and the like are arranged in each of the optical units.

In particular, the object of the present invention is to determine outgoing positions and outgoing angles of a plurality of lights (or light beams) with high accuracy in a pattern writing apparatus using an optical unit array as a light source for emitting the lights, and it is preferable that the above light source module should be used as the optical device element in the optical unit array.

The present invention is intended for a light source module attached to an opening of a mounting plate. According to the present invention, the light source module comprises a light source, a lens part inserted into the opening of the mounting plate, which light from the light source enters and a structure for holding the light source and the lens part, and in the light source module of the present invention, the lens part comprises an outer surface parallel to an optical axis, being inserted into the opening, as a positioning surface used for determining an outgoing position of light relative to the mounting plate by fitting, and the structure comprises a directioning surface provided around the lens part, being substantially perpendicular to the optical axis as a surface used for determining an outgoing angle of light relative to the mounting plate by coming into contact with a main surface of the mounting plate and a pressed part disposed on a side position of the light source which is opposite to the lens part, and pressed towards the directioning surface almost in parallel to the optical axis.

The present invention makes it possible to determine the outgoing position and the outgoing angle of light from the light source module relative to the mounting plate with high accuracy, and providing the pressed part prevents the outgoing position and the outgoing angle of light from the light source module from change with aging.

According to a preferred embodiment, the pressed part is an electric terminal which is pressed by an electric probe connected to a power source and connected to the light source. The mounting plate is connected to the power source, and the positioning surface or the directioning surface is another electric terminal connected to the light source. This simplifies a structure for supplying power to the light source module.

The present invention is also intended for an optical unit array. According to the present invention, the optical unit array comprises a plurality of optical units each having a plurality of optical device elements arranged along a first direction and a holding part for holding the plurality of optical units to be arranged in a second direction substantially perpendicular to the first direction, and in the optical unit array of the present invention, each of the plurality of optical units comprises an arrangement surface parallel to the first direction and the second direction, on which the plurality of optical device elements are arranged, a first protruding portion and a second protruding portion which are disposed away from each other at a predetermined spacing in the first direction, protruding in a direction perpendicular to the arrangement surface and an aligning member having two openings into which the first protruding portion and the second protruding portion are inserted, to which the plurality of optical device elements are attached, the aligning member being used for determining positions of the plurality of optical device elements relative to the first protruding portion and the second protruding portion by fitting the first protruding portion and the second protruding portion into the two openings, and the holding part comprises a first comb-teeth part having a plurality of grooves, for holding a plurality of first protruding portions of the plurality of optical units from outside or inside in the first direction to determine positions of the plurality of first protruding portions in the first direction and the second direction and a second comb-teeth part having a plurality of grooves, for holding a plurality of second protruding portions of the plurality of optical units from outside or inside in the first direction to determine positions of the plurality of second protruding portions in the second direction.

The present invention makes it possible to determine relative positions of a plurality of optical units with high accuracy and easily determine positions of a plurality of optical device elements in the optical unit with high accuracy.

Preferably, the positioning member is a thin film, and this makes it possible to determine positions of optical device elements with no ill effect on the orientation of the optical device elements.

The present invention is further intended for another optical unit array. According to the present invention, the optical unit array comprises a plurality of optical units each having a plurality of optical device elements arranged along a first direction, for emitting a light beam having directivity, a holding part for holding the plurality of optical units to be arranged in a second direction substantially perpendicular to the first direction and at least one plane with which the plurality of optical units are in contact, and in the optical unit array of the present invention, each of the plurality of optical units comprises a flat arrangement surface parallel to the first direction and the second direction, on which the plurality of optical device elements are arranged, being in contact with the at least one plane and a first protruding portion and a second protruding portion serving as arrangement references for the plurality of optical device elements, which are disposed away from each other at a predetermined spacing in the first direction, protruding in a direction perpendicular to the arrangement surface, each of the plurality of optical device elements comprises a directioning surface used for determining an outgoing direction of the light beam by coming into contact with the arrangement surface, and the holding part comprises a first comb-teeth part having a plurality of grooves, for holding a plurality of first protruding portions of the plurality of optical units from outside or inside in the first direction to determine positions of the plurality of first protruding portions and a second comb-teeth part having a plurality of grooves, for holding a plurality of second protruding portions of the plurality of optical units from outside or inside in the first direction to determine positions of the plurality of second protruding portions.

The present invention makes it possible to determine outgoing angles of light rays having a plurality of directivities from a plurality of optical units relative to the optical unit array with high accuracy.

According to a preferred embodiment, each of the plurality of optical units further comprises a pressing part which sandwiches the plurality of optical device elements with the arrangement surface to press the plurality of optical device elements towards the arrangement surface. This makes it possible to prevent the outgoing positions and the outgoing angles of light beams from the optical device elements from change with aging.

Preferably, the pressing part is connected to a power source, and the pressing part comprises a plurality of electric terminals for supplying power to the plurality of optical device elements, respectively, provided at portions which are in contact with the plurality of optical device elements. On the other hand, the arrangement surface is connected to the power source, and the directioning surface of each of the plurality of optical device elements is an electric terminal. In the optical unit array, it is possible to simplify a structure for supplying power to the optical device elements.

The present invention is still further intended for a pattern writing apparatus comprising the above optical unit array, which can perform high-precision pattern writing.

These and other objects, features, aspects and advantages of the present invention will become more apparent from the following detailed description of the present invention when taken in conjunction with the accompanying drawings.

DESCRIPTION OF THE PREFERRED EMBODIMENTS

Hereafter, discussion will be made first on a constitution of a light source module, next on two types of optical unit arrays each comprising a plurality of light source modules which are optical device elements, and then on constitutions of the optical unit arrays.

Figure 1:
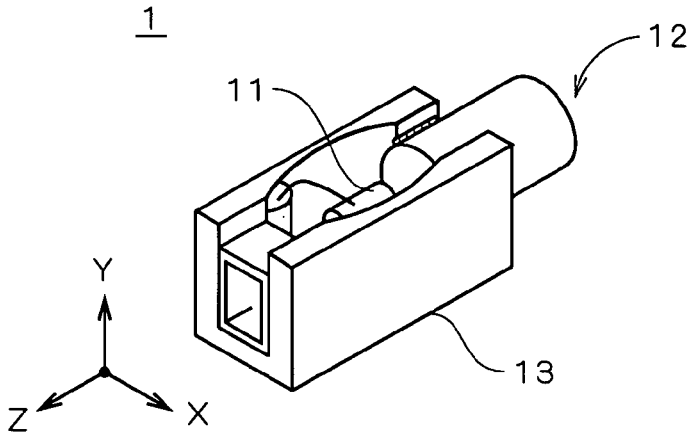
FIG. 1 is a perspective view showing a light source module.

FIG. 1 is a perspective view showing a construction of a light source module 1 used in an optical unit array, and FIGS. 2 to 5 are a plan view, an elevational view from the (+X) side, a left-side elevation and a right-side elevation of the light source module 1, respectively. As shown in FIG. 1, the light source module 1 comprises a bare chip of semiconductor laser (hereinafter, referred to simply as "semiconductor laser) 11 which is a light source for emitting a light ray (hereinafter, referred to as "light beam") having directivity, a lens part 12 which the light beam emitted from the semiconductor laser 11 enters and a structure for holding the semiconductor laser 11 and the lens part 12 (hereinafter, referred to as "platform") 13.

Figure 2:
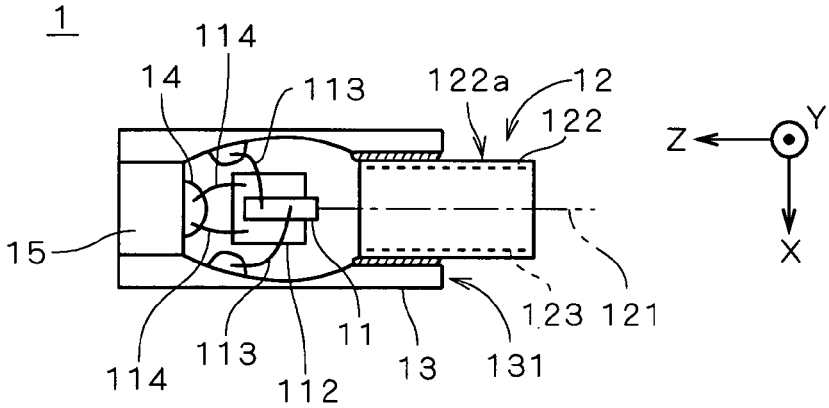
FIGS. 2 to 5 are a plan view, an elevational view, a left-side elevation and a right-side elevation of the light source module, respectively.
Figure 3:
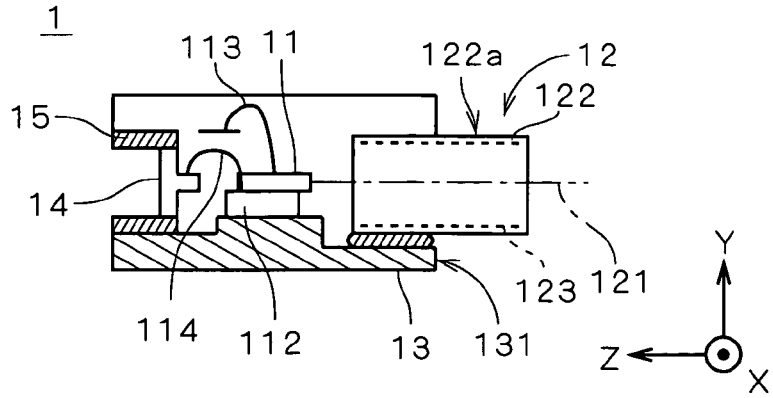

The semiconductor laser 11 is attached onto a submount 112, as shown in FIGS. 2 and 3, and then mounted inside the platform 13 by, e.g., soldering.

The lens part 12 comprises a collimator lens 123 (e.g., SELFOC (registered trademark) lens) having an optical axis 121 indicated by a one-dot chain line in FIGS. 2 and 3 and a cylindrical lens holder 122 having the collimator lens 123 therein, and the central axis of a lens-part outer surface 122*a* of the lens holder 122, the lens-part outer surface 122*a* being parallel to the optical axis 121, coincides with the optical axis 121 with high accuracy. In other words, the center of a section of the lens part 12 taken along a face perpendicular to the optical axis 121 coincides with the optical axis 121 with high accuracy. The lens part 12 may be the collimator lens 123 itself (or a lens whose outer surface is metallized), and in this case, the outer surface of the collimator lens-part 123 corresponds to the lens-part outer surface 122*a*.

The lens part 12 is positioned so that the optical axis 121 and a principal ray of the light beam emitted from the semiconductor laser 11 should coincide with each other with high accuracy and fixed onto the platform 13 by using solder, glass powder, UV adhesive or the like, or by welding with a YAG laser. At this time, (part of) the lens part 12 is so fixed as to protrude outward from the platform 13, which serves as a projection to be used for determining a mounting position of the light source module 1.

Figure 5:
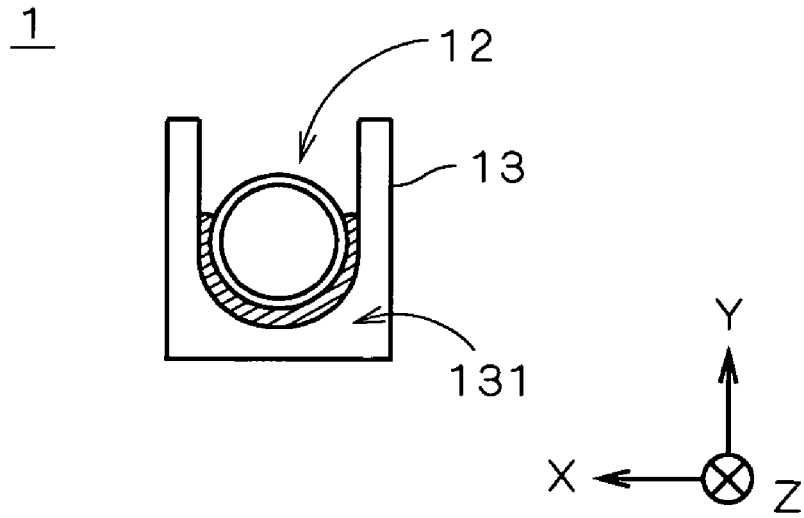

The platform 13 is formed of a material having high thermal conductivity and low thermal expansion, such as copper tungsten (CuW), and have a surface 131 of substantial U-shape surrounding three directions around the lens part 12 ((+X) side, (−X) side and (−Y) side of the lens part 12 in FIG. 5) and a module electrode 14 connected to an electrode on one side of the semiconductor laser 11 (an anode in this preferred embodiment) with a wire 114 by wire bonding. The surface 131 of the platform 13 is perpendicular to the optical axis 121.

Figure 4:
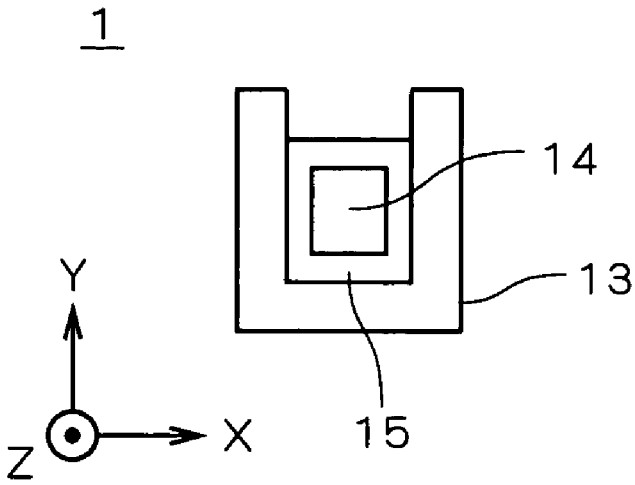

The module electrode 14 is disposed on a side position of the semiconductor laser 11, which is on a side opposite to the lens part 12 and facing the center portion of the surface 131 (in other words, near an extension of the optical axis 121 in the (+Z) direction) as shown in FIG. 3, and the module electrode 14, the semiconductor laser 11, the center portion of the surface 131 and the lens part 12 are substantially aligned in a direction along the optical axis 121. As shown in FIG. 4, the module electrode 14 is bonded, being away from the platform 13, with an insulating material 15 interposed therebetween. A surface of the platform 13 other than portions in contact with the module electrode 14 and the insulating material 15 is gold-plated, and the platform 13 is connected to the other electrode of the semiconductor laser 11 (a cathode in this preferred embodiment) with a wire 113 as shown in FIGS. 2 and 3.

In the light source module 1, with power supplied from a power source through the surface of the platform 13 and the module electrode 14, a light beam is emitted from the semiconductor laser 11, enter the lens part 12 to become a parallel ray of light parallel to the optical axis 121 and go out from the lens part 12.

Figure 6:
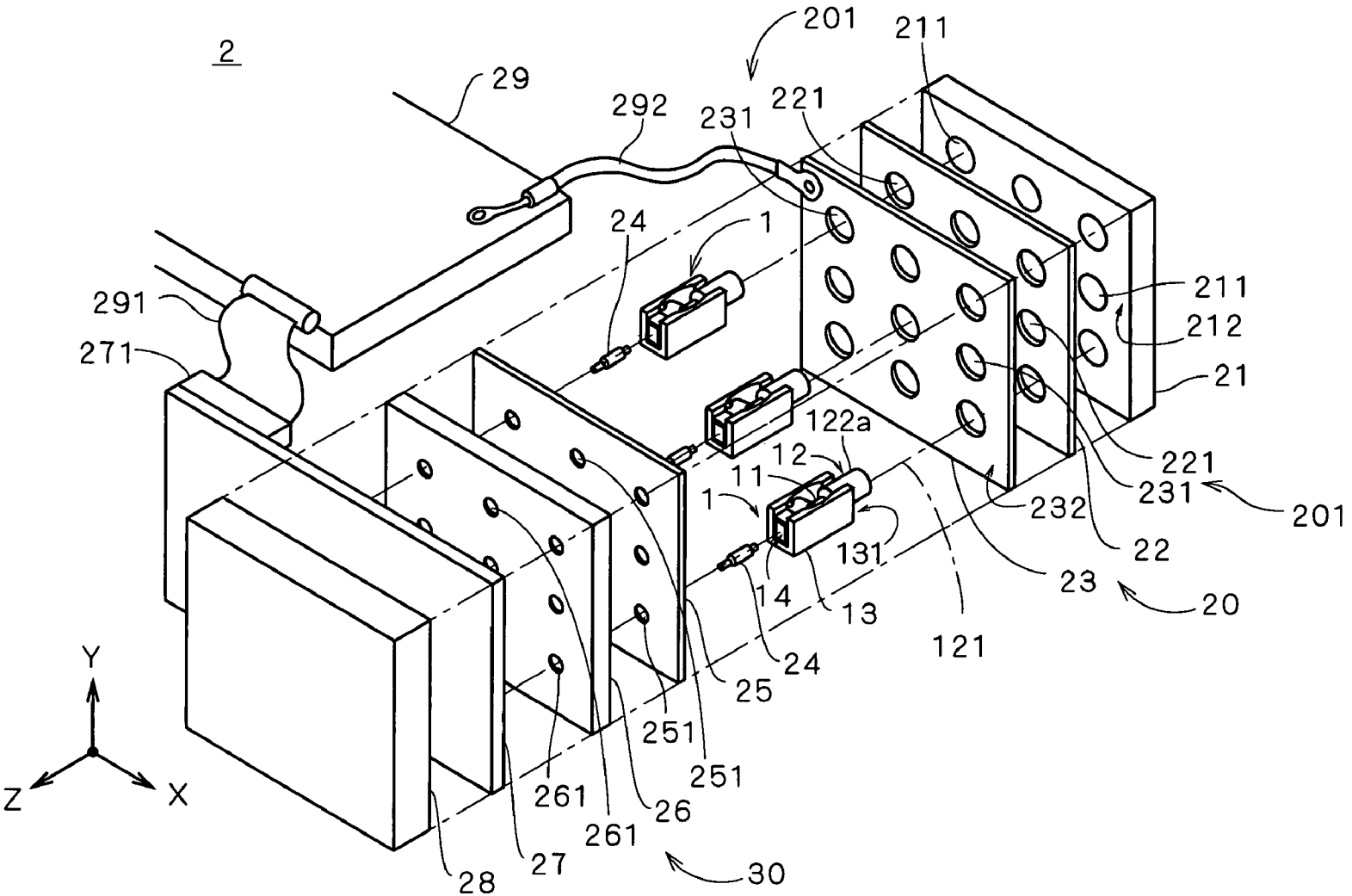
FIG. 6 is an exploded perspective view showing a construction of an optical unit.

FIG. 6 is an exploded perspective view showing a construction of an optical unit 2 comprising a plurality of (in this preferred embodiment, nine) light source modules 1. FIG. 6 shows only three light source modules 1, for convenience of illustration.

The optical unit 2 comprises a mounting plate 20 (consisting of two plates 22 and 23 discussed later) provided with a plurality of mounting openings 201 for insertion of the light source modules 1 and a unit base 21 provided with a plurality of openings 211 corresponding to a plurality of mounting openings 201 on a side where light beams go out from a plurality of light source modules 1. The mounting plate 20 has a thin-film aligning plate 22 on which a plurality of positioning openings 221 for insertion of a plurality of light source modules 1 to be aligned are formed by etching at predetermined positions with high accuracy and a directioning plate 23 on which a plurality of openings 231 slightly larger than the positioning openings 221 are formed at positions corresponding to the positioning openings 221. The mounting openings 201 are openings where the positioning openings 221 and the openings 231 overlap each other, and a surface of the directioning plate 23 on the (+Z) side serves as an arrangement surface 232 which is a plane on which a plurality of light source modules 1 are arranged.

The optical unit 2 further comprises a pressing part 30 which sandwiches a plurality of light source modules 1 with the arrangement surface 232 and presses the light source modules 1 towards the arrangement surface 232, and the pressing part 30 comprises a plurality of electric probes 24 (only three electric probes are shown) which are electric terminals provided at portions for making contact with a plurality of light source modules 1 for supplying power to the light source modules 1, a thermal conductive sheet 25 provided with a plurality of openings 251 for insertion of the electric probes 24, a probe holding plate 26 provided with a plurality of openings 261 corresponding to the openings 251, for holding the electric probes 24 to be inserted into the openings 261, a printed wiring board 27 (hereinafter referred to as "PWB") with which a plurality of electric probes 24 come into contact and a heatsink 28 (e.g., a water-cooling jacket, an air-cooling fan, a Peltier device or the like). The electric probe 24 is in a substantially cylindrical shape and has a spring therein, thereby being elastically contracted by a pressing force applied in a longitudinal direction.

In fabricating the optical unit 2, first, the aligning plate 22 is attached to a reference surface 212 of the unit base 21, with its side opposite to the side for insertion of the light source modules 1 brought into contact therewith, and the directioning plate 23 is attached to the unit base 21, sandwiching the aligning plate 22 with the reference surface 212. The directioning plate 23 has a thickness of 0.1 to 0.2 mm and also serves as a reinforcing plate which sandwiches the thin-film aligning plate 22 with the unit base 21 for reinforcement.

Subsequently, respective lens parts 12 in a plurality of light source modules 1 are inserted into the mounting openings 201 of the mounting plate 20. Each of the positioning openings 221 of the aligning plate 22 is formed so that its center portion coincides with the optical axis 121 of the corresponding lens part 12 with high accuracy and its inner diameter should allow the lens-part outer surface 122*a* to be fitted therein with high accuracy, and the lens-part outer surface 122*a* to be inserted into the corresponding positioning opening 221 is a reference surface used for determining a position of the optical axis 121 relative to the mounting plate 20 by fitting, i.e., an outgoing position of a light beam (hereinafter, the lens-part outer surface 122*a* is referred to as "positioning surface 122a").

The arrangement surface 232 of the directioning plate 23 which is a constituent of the mounting plate 20 is a plane with high flatness, and the surface 131 provided around the lens part 12 of each of a plurality of light source modules 1 (see FIG. 5), being perpendicular to the optical axis 121, serves as a reference surface (hereinafter, the surface 131 is referred to as "directioning surface 131") used for determining an outgoing angle (outgoing direction) of a light beam relative to the mounting plate 20 (which represents a tilt angle or a tilt direction relative to the normal of the mounting plate 20) by coming into contact with the arrangement surface 232.

Thus, a plurality of light source modules 1 are attached to the mounting plate 20 (i.e., the aligning plate 22 and the directioning plate 23) and the positions of the light source modules 1 relative to the optical unit 2 are determined by fitting (the positioning surfaces 122*a* of) the respective lens parts 12 into the positioning openings 221, and the outgoing directions of the light beams emitted from the light source modules 1 are determined by bringing (the directioning surfaces 131 of) the light source modules 1 into contact with the arrangement surface 232.

Next, a plurality of openings 251 of the thermal conductive sheet 25 and a plurality of openings 261 of the probe holding plate 26 are positioned to the corresponding module electrodes 14 of the light source modules 1 and so attached to the unit base 21 as to sandwich the light source modules 1 with the arrangement surface 232 (mounting screws and the like are not shown). The electric probes 24 are inserted into a plurality of openings 251 and a plurality of openings 261 almost in parallel to the optical axes 121 of the lens parts 12, respectively, and tips of the electric probes 24 come into contact with the module electrodes 14 of the light source modules 1.

Subsequently, the PWB 27 connected to the power source 29 through a connector 271 and a cable 291 comes into contact with end portions of a plurality of electric probes 24 which are opposite to the tips in contact with the module electrodes 14 to be attached to the probe holding plate 26. On a surface of the PWB 27 to be brought into contact with the electric probes 24, wires corresponding to a plurality of electric probes 24 are formed in advance. A plurality of electric probes 24 are elastically contracted between the PWB 27 and a plurality of light source modules 1 and press the light source modules 1 by a force of some tens gram-weight towards the arrangement surface 232 of the directioning plate 23. In more detail, the module electrodes 14 which are pressed parts directly pressed by coming into contact with the one end portions of the elastically contracted electric probes 24 are pressed by the electric probes 24 connected to the power source 29 through the PWB 27 towards the directioning surfaces 131 almost in parallel to the optical axes 121 of the lens parts 12 and the directioning surfaces 131 are thereby pressed against and brought into close contact with the arrangement surface 232.

At this time, one electrode (anode) of the semiconductor laser 11 in each of the light source modules 1 is electrically connected to the power source 29 through the module electrode 14, the electric probe 24 and the PWB 27. Another electrode (cathode) of the semiconductor laser 11 is electrically connected to the arrangement surface 232 of the mounting plate 20 through the directioning surface 131 of the platform 13 which is gold-plated and the conductive arrangement surface 232 is connected to the power source 29 through a common cable 292. In other words, the module electrode 14 and the directioning surface 131 of each of the light source modules 1 serve as electric terminals which are connected to the semiconductor laser 11 of the light source module 1 and supply the semiconductor laser 11 with power.

If the positioning surfaces (lens-part outer surfaces) 122*a* of the light source modules 1 and the aligning plate 22 (e.g., a thin film metal plate) into which these surfaces are fitted are conductive, the positioning surface 122*a* may be used as one of the electric terminals of the light source module I instead of the directioning surface 131. In this case, the electrode (cathode) of the semiconductor laser 11 may be connected to the positioning surface 122*a* through a gold-plated surface of the light source module 1 or may be connected directly to the positioning surface 122*a* by wire bonding or the like. Connection between the aligning plate 22 and the power source 29 may be performed through the directioning plate 23 or directly.

Figure 7:
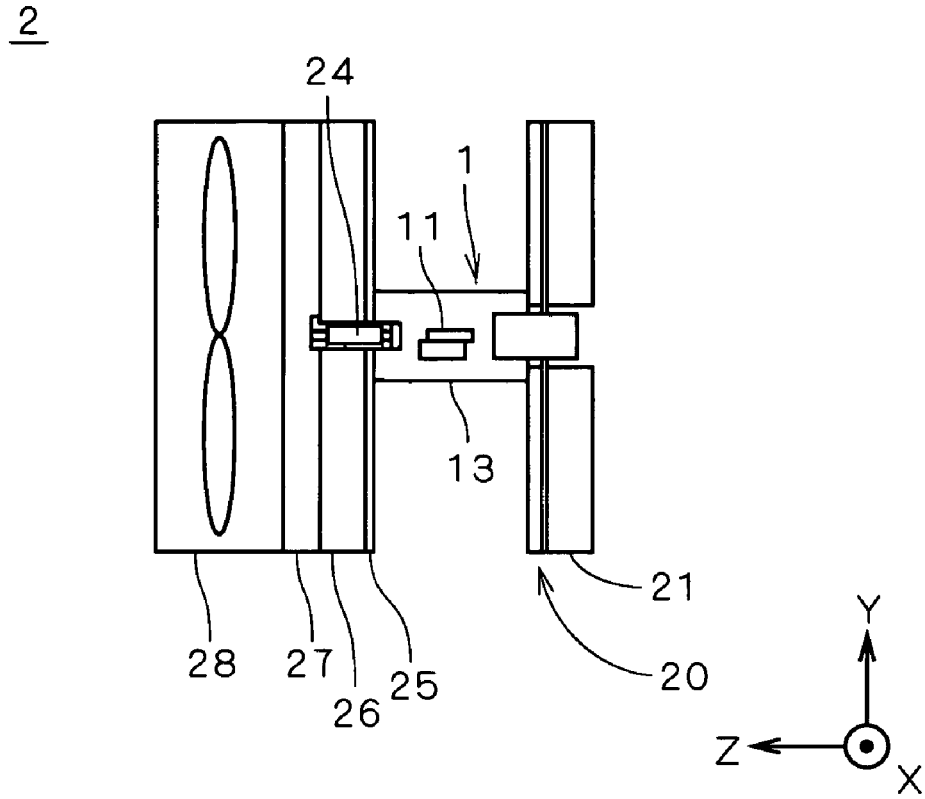
FIG. 7 is a cross section showing the construction of the optical unit.

In the optical unit 2, the heatsink 28 is attached to a back surface of the PWB 27 (a surface opposite to the main surface on which the wires to be brought into contact with the electric probes 24 are formed in advance), being in contact therewith. FIG. 7 is a cross section showing the construction of the fabricated optical unit 2. FIG. 7 only shows on light source module 1, for convenience of illustration. Screws (not shown) connect the unit base 21 and the mounting plate 20 to the probe holding plate 26 and the PWB 27.

As discussed above, in the optical unit 2 using a plurality of light source modules 1, the light source modules 1 arranged on the mounting plate 20 are pressed against the mounting plate 20 with the electric probes 24 and then supplied with power through the electric probes 24 and the mounting plate 20 to emit a plurality of light beams at the outgoing angles from the outgoing positions which are determined with high accuracy. At this time, a plurality of semiconductor lasers 11 release a large amount of thermal energy. The released thermal energy is transmitted to the probe holding plate 26 through the platforms 13 formed of copper tungsten with high thermal conductivity and the thermal conductive sheet 25 with high efficiency. Since the copper tungsten has low thermal expansion as discussed earlier, it is possible to suppress deformation of the light source modules 1 due to the thermal energy released from the semiconductor lasers 11 and further suppress variation of the outgoing positions and the outgoing angles of the light beams.

The thermal energy transmitted to the probe holding plate 26 is transmitted to the heatsink 28 through the PWB 27 and dissipated from the heatsink 28 with high efficiency. It is preferable that the probe holding plate 26 and the PWB 27 should be formed of ceramics such as aluminum nitride (AlN) or beryllia (beryllium oxide (BeO)) or the like, having high thermal radiation and insulating properties suitable for supplying power from the power source 29 (see FIG. 6) to the light source modules 1 through the electric probes 24. As discussed above, in the optical unit 2, even if a plurality of semiconductor lasers 11 which are light sources of high power output, releasing a significant amount of heat, are used, the thermal energy generated from the light sources is transmitted to the heatsink 28 disposed in the rear side of the light source modules 1 (on a side opposite to the side where light beams go out) with high efficiency to thereby ensure a sufficient amount of heat to be dissipated.

As the above discussion has been made on the light source module 1 and the optical unit 2, in the light source module 1 which is a minimum unit of light source, the outgoing position of the light beam relative to the mounting plate 20 can be determined with high accuracy by inserting the positioning surface 122*a* into the positioning opening 221 of the mounting plate 20 to be attached to the mounting plate 20 through fitting. The outgoing angle of the light beam relative to the mounting plate 20 can be determined with high accuracy by bringing the directioning surface 131 into contact with the arrangement surface 232 of the mounting plate 20. Since the outgoing portion of the light beam (the end surface of the lens part 12 on the light-outgoing side), the positioning surface 122*a* and the directioning surface 131 are disposed closely, it is possible to determine the outgoing position and the outgoing angle of the light beam with high accuracy and also possible to easily manufacture the light source module 1.

In the light source module 1, since the module electrode 14 which is the pressed part is pressed and the directioning surface 131 is thereby pressed against the arrangement surface 232 of the mounting plate 20, it is possible to prevent the outgoing position and the outgoing angle of the light beam emitted from the light source module 1 from change with aging.

Further, in the light source module 1, since the module electrode 14 and the directioning surface 131 (or the positioning surface 122*a*) serve as electric terminals for supplying the semiconductor laser 11 with power, it is possible to simplify the structure for supplying power and determine the outgoing position and the outgoing angle of the light beam without constraint of wires. Since connection with the structure for supplying power (e.g., soldering of wires to the electric terminals) which is made after attachment of the light source modules 1 is also simplified (or is omitted), it is possible to prevent shifts of the already-determined outgoing positions and outgoing angles of the light beams.

Figure 8:
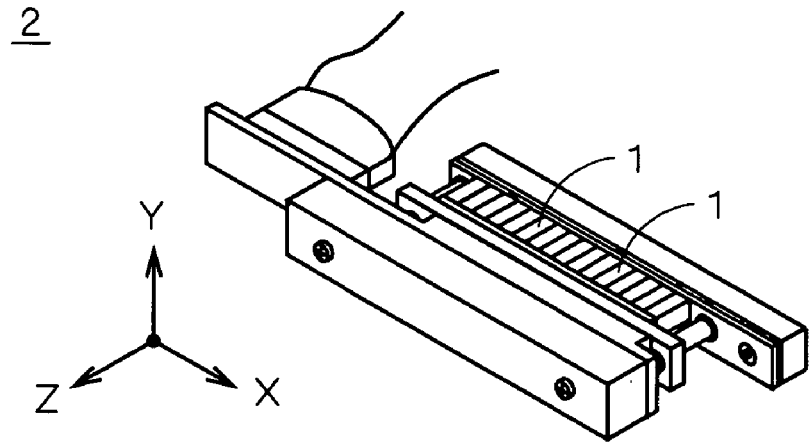
FIG. 8 is a perspective view showing another-type optical unit.
Figure 9:
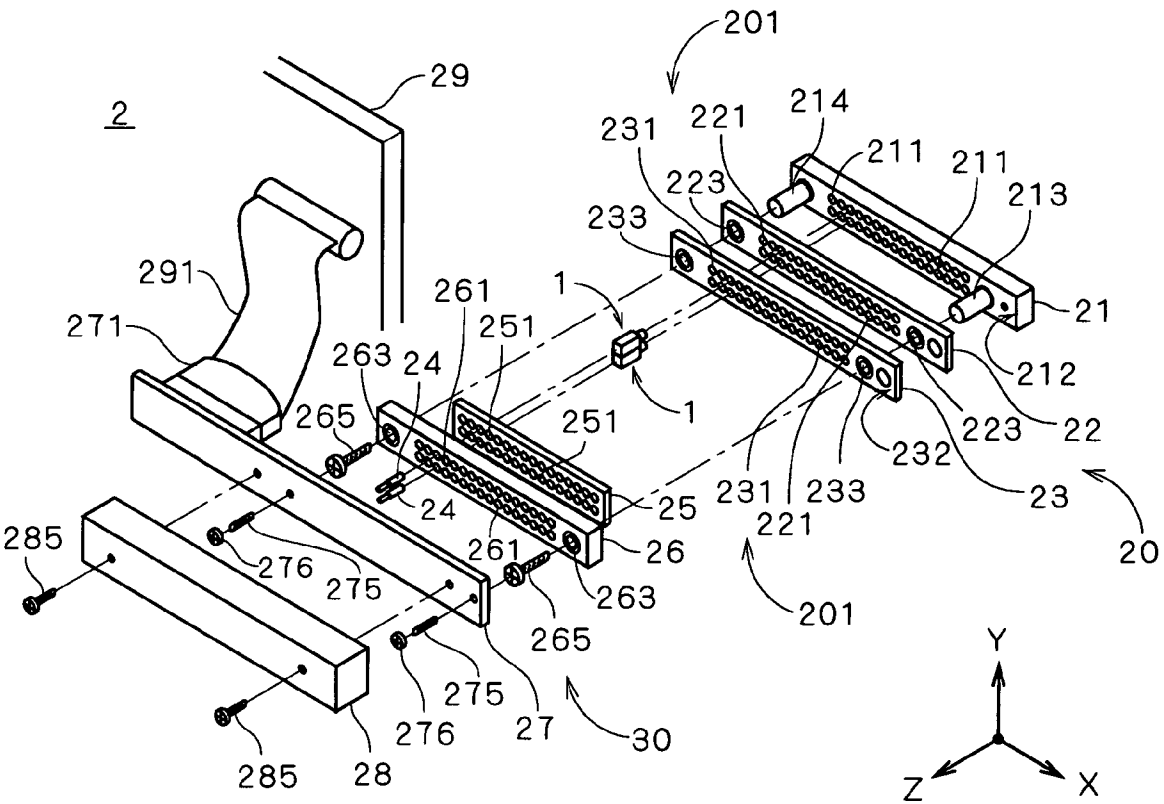
FIG. 9 is an exploded perspective view showing a construction of the optical unit.

FIG. 8 is a perspective view showing another example of the optical unit 2 comprising a plurality of (in this preferred embodiment, thirty-two) light source modules 1, and FIG. 9 is an exploded perspective view showing a construction of the optical unit 2. Though FIG. 9 shows only two light source modules 1, for convenience of illustration, actually sixteen light source modules 1 are aligned in the X direction of FIG. 9 (hereinafter, the direction of arrangement of the light source modules 1 is referred to as "arrangement direction of the light source modules 1") and another row of (sixteen) light source modules 1 are arranged in parallel with the above light source modules 1.

The optical unit 2 comprises the mounting plate 20 (consisting of two plates 22 and 23 discussed later) provided with a plurality of mounting openings 201 for insertion of the light source modules 1 and the unit base 21 provided with a plurality of openings 211 corresponding to a plurality of mounting openings 201 on a side where light beams go out from a plurality of light source modules 1.

The mounting plate 20 has the thin-film aligning plate 22 on which a plurality of positioning openings 221 for insertion of a plurality of light source modules 1 are formed by etching at predetermined positions with high accuracy and the directioning plate 23 on which a plurality of openings 231 slightly larger than the positioning openings 221 are formed at positions corresponding to the positioning openings 221. The mounting openings 201 are openings where the positioning openings 221 and the openings 231 overlap each other, and a surface of the directioning plate 23 on the (+Z) side serves as the arrangement surface 232 which is a plane on which a plurality of light source modules 1 are arranged.

The unit base 21 comprises the reference surface 212 facing the aligning plate 22, being parallel to the arrangement surface 232, and the reference surface 212 is provided with a first pin 213 which is a protruding portion protruding in a direction perpendicular to the arrangement surface 232 and the reference surface 212 and a second pin 214 disposed away from the first pin 213 at a predetermined spacing in the arrangement direction of the light source modules 1 (the (−X) direction of FIG. 9), protruding in a direction perpendicular to the arrangement surface 232 and the reference surface 212. The first pin 213 and the second pin 214 may be formed as a unit with the unit base 21 or may be attached to the unit base 21 by press-fitting. The aligning plate 22 is provided with two pin openings 223 into which the first pin 213 and the second pin 214 are inserted and the directioning plate 23 is also provided with two pin openings 233.

The optical unit 2 further comprises the pressing part 30 which sandwiches a plurality of light source modules 1 with the arrangement surface 232 and presses the light source modules 1 towards the arrangement surface 232, and the pressing part 30 comprises a plurality of electric probes 24 (only two electric probe are shown) which are electric terminals provided at portions for making contact with a plurality of light source modules 1 for supplying power to the light source modules 1, the thermal conductive sheet 25 provided with a plurality of openings 251 for insertion of the electric probes 24, the probe holding plate 26 provided with a plurality of openings 261 corresponding to the openings 251, for holding the electric probes 24 to be inserted into the openings 261 and the PWB 27 with which a plurality of electric probes 24 come into contact.

Figure 10:
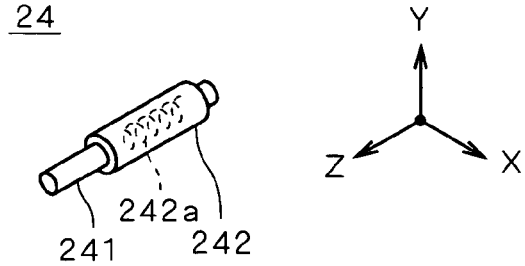
FIG. 10 is a view showing an electric probe.

FIG. 10 is a view showing the electric probe 24. The electric probes 24 shown in FIG. 6 have the same structure. The electric probe 24 has a probe pin 241 of substantially cylindrical shape and a probe body 242 of substantially cylindrical shape, having a spring 242*a* therein. The electric probe 24 is elastically contracted by pressing forces applied from both sides in a longitudinal direction (in other words, with contraction of the spring 242*a*, the probe pin 241 is moved towards the inside of the probe body 242). The probe holding plate 26 of FIG. 9 is provided with two pin openings 263 corresponding to the first pin 213 and the second pin 214.

In fabricating the optical unit 2, first, the first pin 213 and the second pin 214 are inserted to the two pin openings 223 of the aligning plate 22 and the aligning plate 22 is attached to the reference surface 212 of the unit base 21, with its side opposite to the side for insertion of the light source modules 1 brought into contact therewith. In the optical unit 2, the position of the aligning plate 22 relative the first pin 213 and the second pin 214 is determined by fitting the first pin 213 and the second pin 214 into the two pin openings 223 of the aligning plate 22. Subsequently, the directioning plate 23 is attached to the unit base 21, sandwiching the aligning plate 22 with the reference surface 212. The directioning plate 23 has a thickness of 0.1 to 0.2 mm and also serves as a reinforcing plate which sandwiches the thin-film aligning plate 22 with the unit base 21 for reinforcement.

Next, respective lens parts 12 in a plurality of light source modules 1 of FIG. 2 are inserted into the mounting openings 201 of the mounting plate 20 (the positioning openings 221 of the aligning plate 22) of FIG. 9. Each of the positioning openings 221 is formed so that its center portion coincides with the optical axis 121 of the corresponding lens part 12 with high accuracy and its inner diameter should allow the lens-part outer surface 122*a* to be fitted therein with high accuracy, and the lens-part outer surface 122*a* to be inserted into the corresponding positioning opening 221 is a reference surface used for determining a position of the optical axis 121 relative to the aligning plate 22 of the mounting plate 20 (in the optical unit 2) by fitting, i.e., an outgoing position of a light beam (hereinafter, the lens-part outer surface 122*a* is referred to as "positioning surface 122a" like in the case of FIG. 6). As discussed above, since the aligning plate 22 is aligning relatively to the first pin 213 and the second pin 214, the respective positions of a plurality of light source modules 1 and the optical axes 121 relative to the first pin 213 and the second pin 214 are determined by inserting the lens parts 12 into the positioning openings 221.

The arrangement surface 232 of the directioning plate 23 which is a constituent of the mounting plate 20 is a plane with high flatness, and the surface 131 provided around the lens part 12 of each of a plurality of light source modules 1 (see FIG. 5), being perpendicular to the optical axis 121, serves as a reference surface (hereinafter, the surface 131 is referred to as "directioning surface 131" like in the case of FIG. 6) used for determining an outgoing angle (outgoing direction) of a light beam relative to the mounting plate 20 (which represents a tilt angle or a tilt direction relative to the normal of the mounting plate 20) by coming into contact with the arrangement surface 232.

Thus, a plurality of light source modules 1 are attached to the mounting plate 20 (i.e., the aligning plate 22 and the directioning plate 23) and the respective positions of the light source modules 1 and the optical axes 121 relative to the optical unit 2 are determined with the first pin 213 and the second pin 214 as arrangement references by fitting (the positioning surfaces 122*a* of) the respective lens parts 12 into the positioning openings 221, and the outgoing directions of the light beams emitted from the light source modules 1 are determined by bringing (the directioning surfaces 131 of) the light source modules 1 into contact with the arrangement surface 232.

Next, a plurality of openings 251 of the thermal conductive sheet 25 and a plurality of openings 261 of the probe holding plate 26 are positioned to the corresponding module electrodes 14 (see FIG. 4) of the light source modules 1 and so attached to (the first pin 213 and the second pin 214 of) the unit base 21 with fixing screws 265 to be inserted into the two pin openings 263 as to sandwich the light source modules 1 with the arrangement surface 232. The electric probes 24 are inserted into a plurality of openings 251 and a plurality of openings 261 almost in parallel to the optical axes 121 of the lens parts 12 (see FIGS. 2 and 3), respectively, and tips of the electric probes 24 come into contact with the module electrodes 14 of the light source modules 1.

Subsequently, the PWB 27 connected to the power source 29 through a connector 271 and the cable 291 comes into contact with end portions of a plurality of electric probes 24 which are opposite to the tips in contact with the module electrodes 14 to be attached to (the fixing screws 265 of) the probe holding plate 26 with mounting pins 275 and mounting nuts 276. On a surface of the PWB 27 to be brought into contact with the electric probes 24, wires corresponding to a plurality of electric probes 24 are formed in advance. A plurality of electric probes 24 are elastically contracted between the PWB 27 and a plurality of light source modules 1 and press the light source modules 1 by a force of some tens gram-weight towards the arrangement surface 232 of the directioning plate 23. In more detail, the module electrodes 14 which are pressed parts directly pressed by coming into contact with the one end portions of the elastically contracted electric probes 24 are pressed by the electric probes 24 connected to the power source 29 through the PWB 27 towards the directioning surfaces 131 almost in parallel to the optical axes 121 of the lens parts 12 and the directioning surfaces 131 are thereby pressed against and brought into close contact with the arrangement surface 232.

At this time, one electrode (anode) of the semiconductor laser 11 in each of the light source modules 1 is electrically connected to the power source 29 through the module electrode 14, the electric probe 24 and the PWB 27. Another electrode (cathode) of the semiconductor laser 11 is electrically connected to the arrangement surface 232 of the mounting plate 20 through the directioning surface 131 of the platform 13 which is gold-plated and the conductive arrangement surface 232 is connected to the power source 29 through the first pin 213 and the second pin 214 to be inserted into the pin openings 233 of the directioning plate 23 and the PWB 27 electrically connected to the fixing screws 265 attached to the first pin 213 and the second pin 214. In other words, the module electrode 14 and the directioning surface 131 of each of the light source modules 1 of FIGS. 2 and 3 serve as electric terminals which are connected to the semiconductor laser 11 of the light source module 1 and supply the semiconductor laser 11 with power.

If the positioning surfaces (lens-part outer surfaces) 122*a* of the light source modules 1 and the aligning plate 22 (e.g., a thin film plate) into which these surfaces are fitted are conductive, the positioning surface 122*a* may be used as one of the electric terminals of the light source module 1 instead of the directioning surface 131. In this case, the electrode (cathode) of the semiconductor laser 11 may be connected to the positioning surface 122*a* through a gold-plated surface of the light source module 1 or may be connected directly to the positioning surface 122*a* by wire bonding or the like. The aligning plate 22 is connected to the power source 29 like the arrangement surface 232 of the directioning plate 23 as discussed above.

Figure 11:
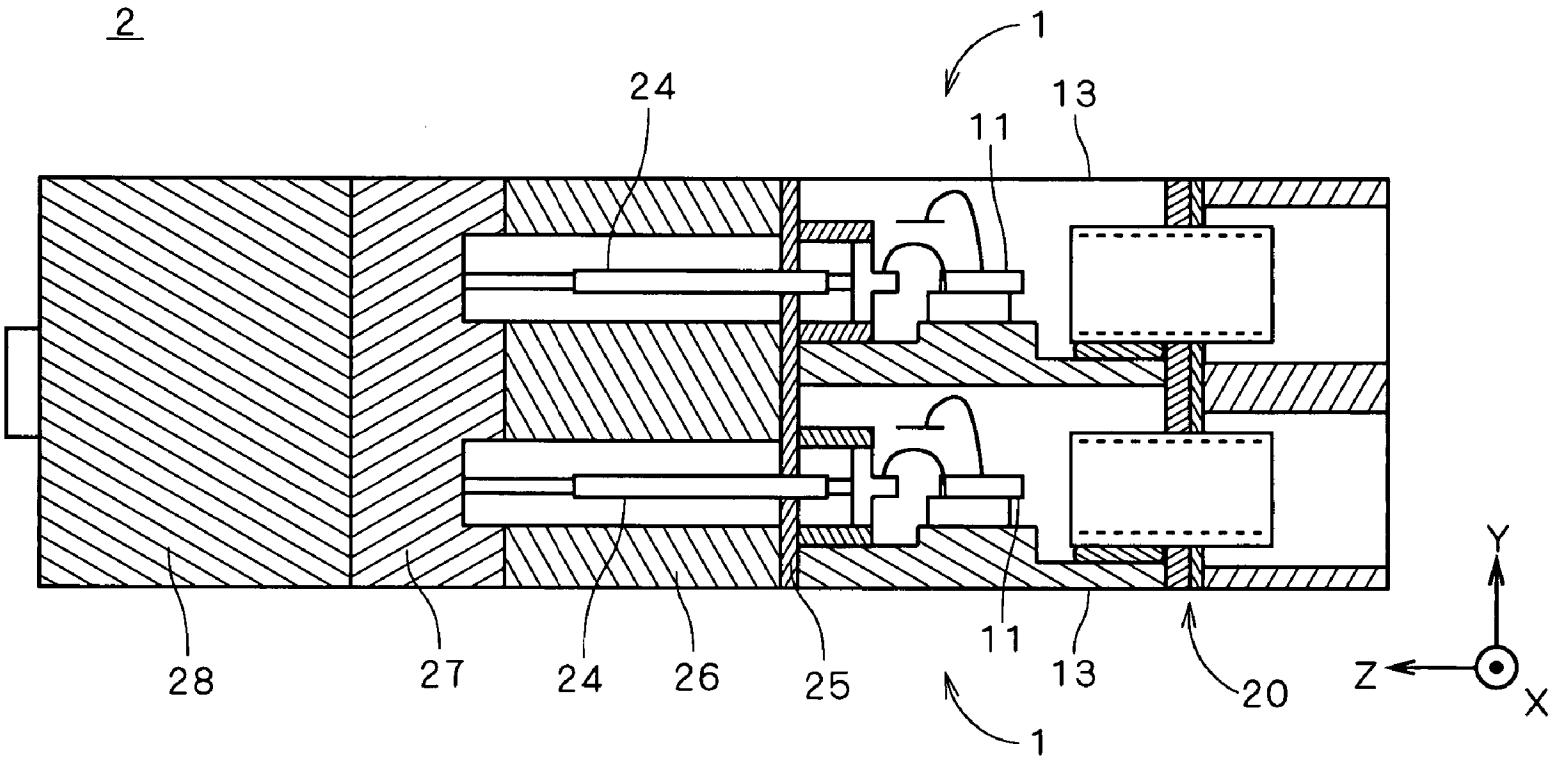
FIG. 11 is a cross section showing the construction of the optical unit.

In the optical unit 2, the heatsink 28 is attached to the back surface of the PWB 27 (the surface opposite to the main surface on which the wires to be brought into contact with the electric probes 24 are formed in advance) with fixing screws 285, being in contact therewith. FIG. 11 is a cross section showing the construction of the fabricated optical unit 2.

As discussed above, in the optical unit 2 using a plurality of light source modules 1, the light source modules 1 arranged on the mounting plate 20 are pressed against the mounting plate 20 with the electric probes 24 and then supplied with power through the electric probes 24 and the mounting plate 20 to emit a plurality of light beams at the outgoing angles from the outgoing positions which are determined with high accuracy. At this time, a plurality of semiconductor lasers 11 release a large amount of thermal energy. The released thermal energy is transmitted to the probe holding plate 26 through the platforms 13 formed of copper tungsten with high thermal conductivity and the thermal conductive sheet 25 with high efficiency. Since the copper tungsten has low thermal expansion as discussed earlier, it is possible to suppress deformation of the light source modules 1 due to the thermal energy released from the semiconductor lasers 11 and further suppress variation of the outgoing positions and the outgoing angles of the light beams.

The thermal energy transmitted to the probe holding plate 26 is transmitted to the heatsink 28 through the PWB 27 and dissipated from the heatsink 28 with high efficiency. It is preferable that the probe holding plate 26 and the PWB 27 should be formed of ceramics such as aluminum nitride (AlN) or beryllia (beryllium oxide (BeO)) or the like, having high thermal radiation and insulating properties suitable for supplying power from the power source 29 (see FIG. 9) to the light source modules 1 through the electric probes 24 and the like. As discussed above, in the optical unit 2, even if a plurality of semiconductor lasers 11 which are light sources of high power output, releasing a significant amount of heat, are used, the thermal energy generated from the light sources is transmitted to the heatsink 28 disposed in the rear side of the light source modules 1 (on a side opposite to the side where light beams go out) with high efficiency to thereby ensure a sufficient amount of heat to be dissipated.

Figure 12:
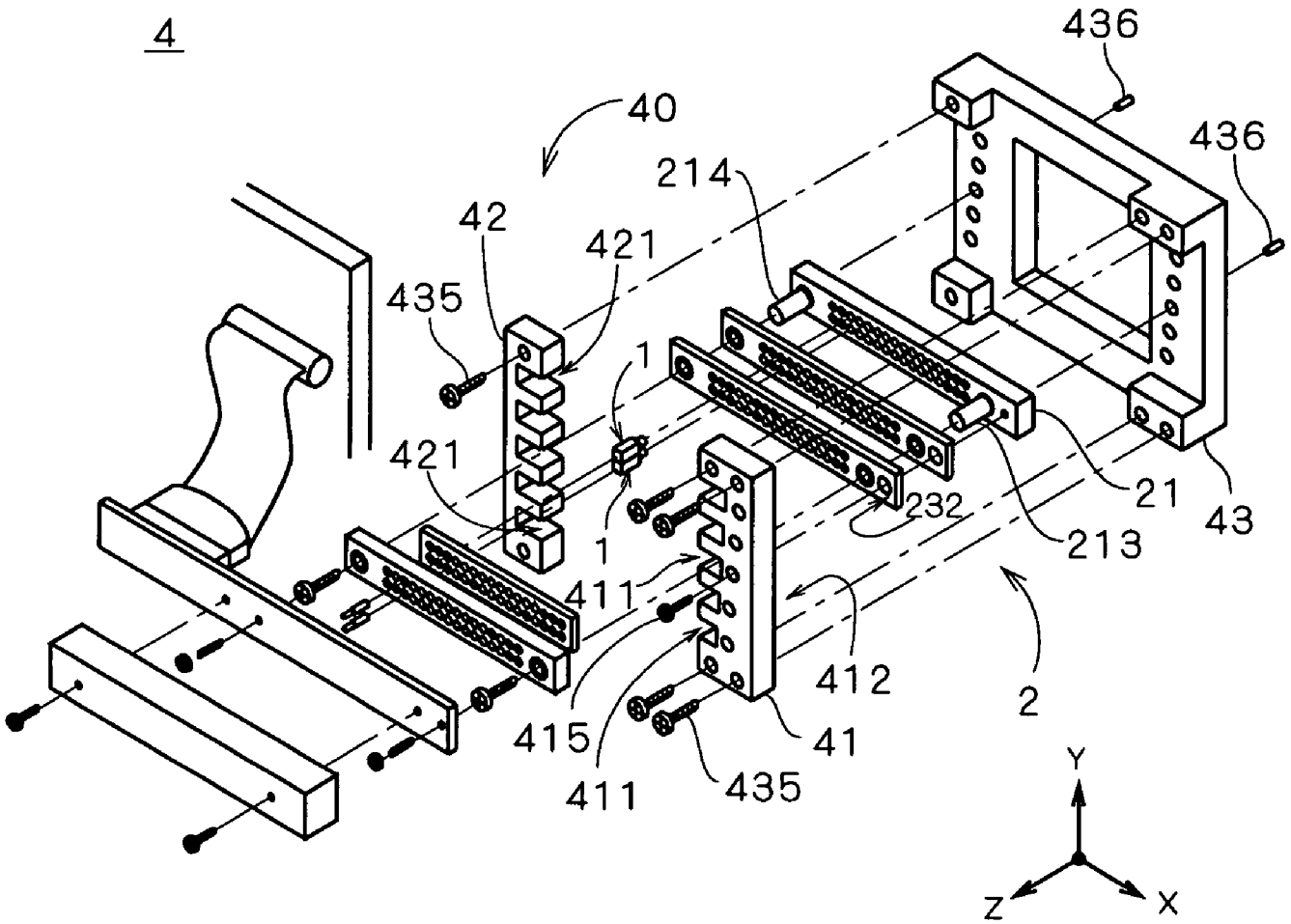
FIG. 12 is an exploded perspective view showing a construction of an optical unit array.

FIG. 12 is an exploded perspective view showing a construction of the optical unit array 4 using a plurality of (in this preferred embodiment, five) optical units 2. Though FIG. 12 shows only one optical unit 2, for convenience of illustration, actually five optical units 2 are arranged in a vertical direction (substantially along the Y direction of FIG. 11) perpendicular to the arrangement direction of a plurality of light source modules 1 (the X direction of FIG. 11).

The optical unit array 4 comprises a holding part 40 for holding a plurality of optical units 2 arranged in the above arrangement direction, and the holding part 40 has a first comb-teeth member 41 which is the first comb-teeth part provided with a plurality of grooves 411 used for determining positions of the respective first pins 213 in a plurality of optical units 2 by holding the first pins 213, a second comb-teeth member 42 which is the second comb-teeth part provided with a plurality of grooves 421 used for determining positions of the respective second pins 214 in a plurality of optical units 2 by holding the second pins 214 and an array base 43 to which the first comb-teeth member 41 and the second comb-teeth member 42 are fixed.

The first comb-teeth member 41 and the second comb-teeth member 42 are formed of insulating materials such as ceramics, and the grooves 411 and the grooves 421 are formed by cutting operation with high accuracy. The array base 43 is formed of stainless steel.

Figure 13:
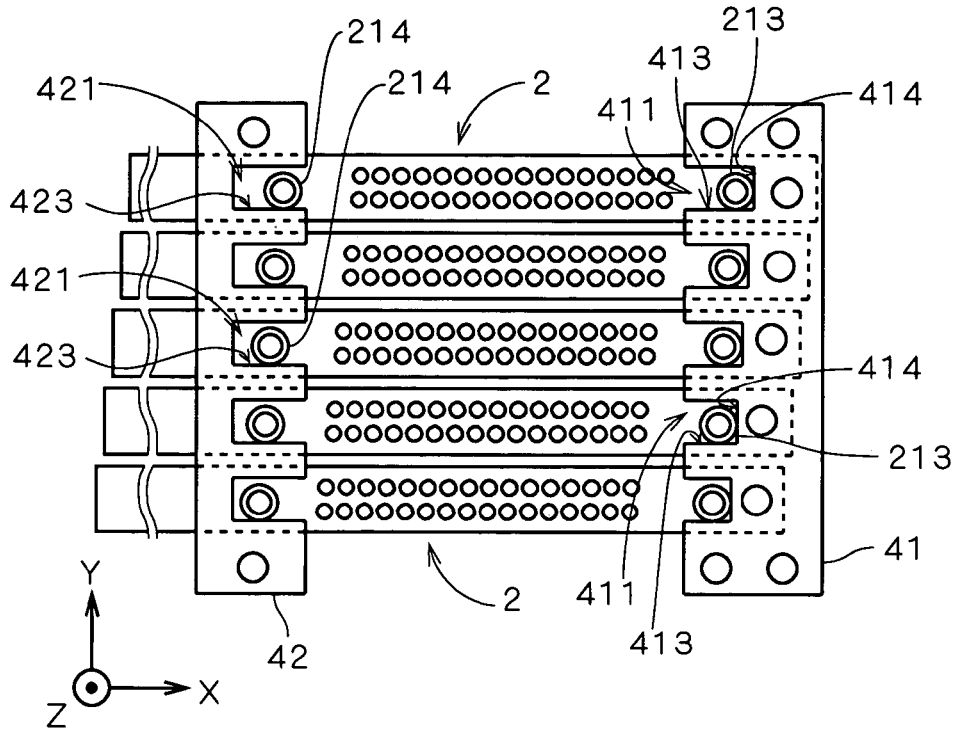
FIG. 13 is a view showing the optical unit, a first comb-teeth member and a second comb-teeth member.

In fabricating the optical unit array 4, first, as shown in FIG. 13, the respective first pins 213 of a plurality of optical units 2 are held by a plurality of grooves 411 of the first comb-teeth member 41 from the outside in the arrangement direction of the light source modules 1 (in other words, on a side of the first pin 213 opposite to the second pin 214), and the respective second pins 214 of a plurality of optical units 2 are held by a plurality of grooves 421 of the second comb-teeth member 42 from the outside in the arrangement direction of the light source modules 1 (in other words, on a side of the second pin 214 opposite to the first pin 213).

Figure 14:
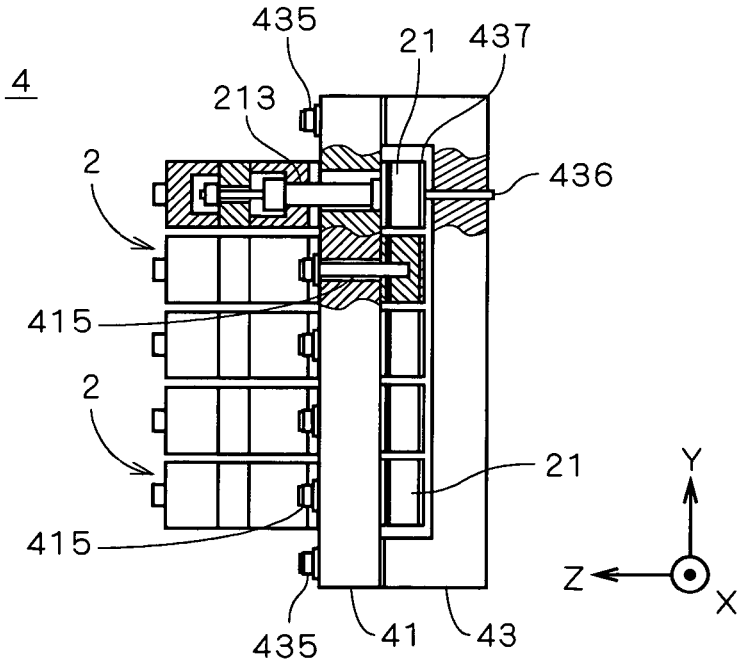
FIG. 14 is a cross section showing the construction of the optical unit array.

After that, a plurality of optical units 2 are fixed to the first comb-teeth member 41 with unit fixing screws 415 as shown in FIG. 14 which is the cross section of the optical unit array 4. The array base 43 is fixed to the first comb-teeth member 41 and the second comb-teeth member 42 with a plurality of screws 435, sandwiching the unit bases 21 with main surfaces of the first comb-teeth member 41 and the second comb-teeth member 42 on the side of the (−Z) direction, as shown in FIGS. 12 and 14. The array base 43 and a plurality of optical units 2 are not in contact with one another and electrically insulated from one another. In FIG. 14, for convenience of illustration, the cross section including the first pin 213 is shown with respect to the uppermost optical unit 2 and the cross section including the unit fixing screw 415 is shown with respect to the second upper optical unit 2.

At this time, each of a plurality of first pins 213 shown in FIG. 13 comes into contact with a bottom surface 414 of each of the grooves 411 in the first comb-teeth member 41, which is perpendicular to the X direction and a side surface 413 thereof (below each groove 411 in FIG. 13) directed towards the (+Y) direction, to thereby determine its position in the X direction and the Y direction (i.e., the arrangement direction of the light source modules 1 and the arrangement direction of the optical units 2, respectively), and each of a plurality of second pins 214 comes into contact with a side surface 423 below each groove 421 of the second comb-teeth member 42, to thereby determine its position in the Y direction (i.e., the arrangement direction of the optical units 2). As a result, the positions of a plurality of optical units 2 in the optical unit array 4 are determined and the outgoing positions of the light beams emitted from a plurality of light source modules 1 disposed in each of the optical units 2 are determined.

The arrangement surface 232 of each of a plurality of optical units 2 is parallel to the arrangement direction of the light source modules 1 and the arrangement direction of the optical units 2, as shown in FIG. 12, and brought into contact with a main surface 412 of the first comb-teeth member 41 on the (−Z) side (hereinafter, referred to as "array reference surface 412") with the unit fixing screw 415. Each of a plurality of optical units 2 is pressed by a unit pressing screw 436 made of stainless steel from a side of the unit base 21 facing the array base 43 through an insulating film 437 (see FIG. 14), and the arrangement surface 232 is thereby pressed against the array reference surface 412. The array reference surface 412 is a flat plane formed in parallel to the arrangement direction of the light source modules 1 and the arrangement direction of the optical units 2 and the respective arrangement surfaces 232 in a plurality of optical units 2 are pressed against the array reference surface 412, thereby being arranged in one plane, to determine the outgoing angles of the light beams emitted from a plurality of light source modules 1 arranged in a plurality of optical units 2.

In the optical unit array 4, the array base 43 and a plurality of optical units 2 are electrically insulated from one another with the insulating films 437 interposed therebetween, and it thereby becomes possible to prevent leakage of power to be supplied for a plurality of light source modules 1 into the array base 43. Since the first comb-teeth member 41 and the second comb-teeth member 42 are also made of insulating materials, a plurality of optical units 2 are electrically insulated from one another. If the unit pressing screw 436 is made of an insulating material such as ceramics, the insulating film 437 may be omitted.

The above discussion has been made on another example of the optical unit 2 and the optical unit array 4, and in the optical unit array 4, by bringing the respective first pins 213 and second pins 214 of a plurality of optical units 2 into contact with the first comb-teeth member 41 and the second comb-teeth member 42 which are formed with high accuracy, relative positions of a plurality of optical units 2 and positions of the optical units 2 in the optical unit array 4 can be determined with high accuracy and a plurality of light source modules 1 can be arranged with high accuracy.

In the optical unit 2, the positioning surfaces 122*a* of the lens parts 12 are inserted into the positioning openings 221 of the mounting plate 20 and a plurality of light source modules 1 are attached to the mounting plate 20 by fitting, to thereby determine the respective positions of the light source modules 1 relative to the mounting plate 20 with high accuracy. Since the central axis of the positioning surface 122*a* coincides with the optical axis 121 of the lens part 12 with high accuracy, the position of the optical axis 121 of the lens part 12 in the optical unit 2 can be determined with high accuracy and the outgoing position of the light beam emitted from the light source module 1 can be determined with high accuracy.

The first pin 213 and the second pin 214 are inserted into the pin openings 223 of the mounting plate 20 and the mounting plate 20 is attached to the unit base 21 by fitting, to thereby determine the position of the mounting plate 20 relative to the first pin 213 and the second pin 214 with high accuracy in a simple structure, and the positions of a plurality of light source modules 1 in the optical unit 2 can be easily determined with high accuracy.

In the optical unit 2, by bringing the respective directioning surfaces 131 of a plurality of light source modules 1 into contact with the arrangement surface 232 of the mounting plate 20, the outgoing angles (outgoing directions) of the light beams from the light source modules 1 relative to the optical unit 2 can be determined with high accuracy. Further, by pressing the respective arrangement surfaces 232 of a plurality of optical units 2 against the array reference surface 412, the outgoing angles of the light beams from the optical units 2 relative to the optical unit array 4 can be determined with high accuracy. Since the outgoing portion of the light beam (the end surface of the lens part 12 on the light-outgoing side), the positioning surface 122*a* and the directioning surface 131 are arranged closely, it is possible to determine the outgoing position and the outgoing angle of the light beam with high accuracy and also possible to easily manufacture the light source module 1.

In the optical unit 2, like in the case of FIG. 6, since the module electrode 14 which is the pressed part of the light source module 1 is pressed and the directioning surface 131 is thereby pressed against the arrangement surface 232 of the mounting plate 20, it is possible to prevent the outgoing position and the outgoing angle of the light beam emitted from the light source module 1 from change with aging.

In the optical unit 2, since the aligning plate 22 is a thin film, it is possible to determine the position of the light source module 1 with no effect on the orientation of the light source module 1. Further, since the thin-film aligning plate 22 is sandwiched between the unit base 21 and the directioning plate 23 and thereby reinforced, the light source module 1 can be easily attached to and detached from the aligning plate 22.

In the optical unit array 4, since a plurality of optical units 2 are electrically insulated from one another, the whole power to be supplied for the optical unit array 4 is divided by the optical units 2 and each of the optical units 2 is independently supplied with power (for example, in this preferred embodiment, a current of about 10 Å flows in each optical unit 2). It is therefore possible to avoid upsizing of one wire by wire division.

Since the arrangement surface 232 and the electric probe 24 are connected to the power source 29 in the optical unit 2 and the directioning surface 131 in contact with the arrangement surface 232 (or the positioning surface 122*a* electrically connected to the arrangement surface 232) and the module electrode 14 in contact with the electric probe 24 serve as electric terminals for supplying the semiconductor laser 11 with power in the light source module 1, the structure for supplying power is simplified and the outgoing position and the outgoing angle of the light beam can be determined without constraint of wiring.

Since the electric probe 24 presses the module electrode 14 while being elastically contracted, the electric probe 24 can be surely brought into contact with the light source module 1. Further, since the electric probe 24 and the PWB 27 are formed separately, the optical unit 2 can be easily fabricated. Connection with the structure for supplying power (e.g., soldering of wires to the electric terminals) which is made after attachment of the light source modules 1 is simplified (or is omitted), and it is therefore possible to prevent shifts of the already-determined outgoing positions and outgoing angles of the light beams.

Figure 15:
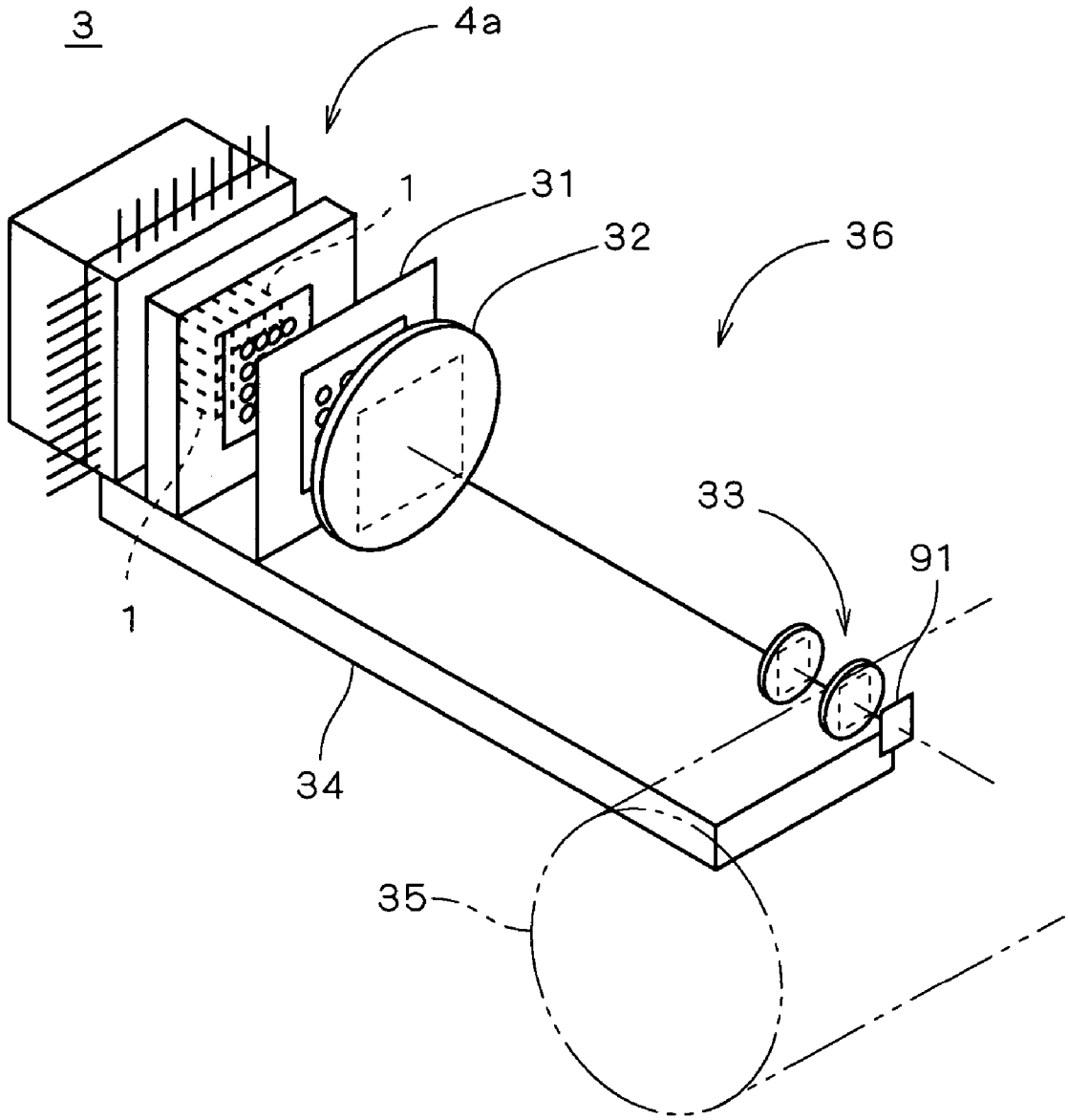
FIG. 15 is a view showing a construction of an image recording apparatus.

FIG. 15 is a view showing a construction of a raster scan type image recording apparatus 3 which comprises an optical unit array 4*a* having almost the same constitution as that of the optical unit array 4 shown in FIG. 12. The image recording apparatus 3 is a pattern writing apparatus for writing pattern on a printing material (plate) as an object, and comprises an optical system 36 for guiding a plurality of light beams emitted from the optical unit array 4*a* to the printing material, a base part 34 for holding these constituent elements and a drum 35 holding a printing material coated with a photosensitive material on its outer surface.

The optical unit array 4*a* in the image recording apparatus 3 has the same constitution as that of the optical unit array 4 shown in FIG. 12 except that four optical units in each of which four light source modules 1 are aligned are vertically arranged.

The optical system 36 has an aperture board 31, a field lens 32 and a zoom optical system 33.

In the image recording apparatus 3, a plurality of light beams emitted from the optical unit array 4*a* are shaped by the aperture board 31, the shaped beams are guided by the field lens 32 and the zoom optical system 33 constituting a both-side telecentric optical system to a writing region 91 of the printing material on the drum 35 and irradiation positions of a plurality of light beams are scanned on the printing material. A main scan of the light beams on the printing material is performed by rotation of the drum 35 about its central axis and a subscan is performed by moving the base part 34 in a direction parallel to the central axis of the drum 35. In the case where shaping of the light beams emitted from the optical unit array 4*a* is not necessary, the aperture board 31 may be omitted.

In the image recording apparatus 3, since a plurality of light source modules 1 are arranged with high accuracy so that a plurality of light beams should be emitted at predetermined outgoing angles from predetermined outgoing positions in the optical unit array 4*a*, it is possible to achieve a high-precision pattern writing.

Figure 16:
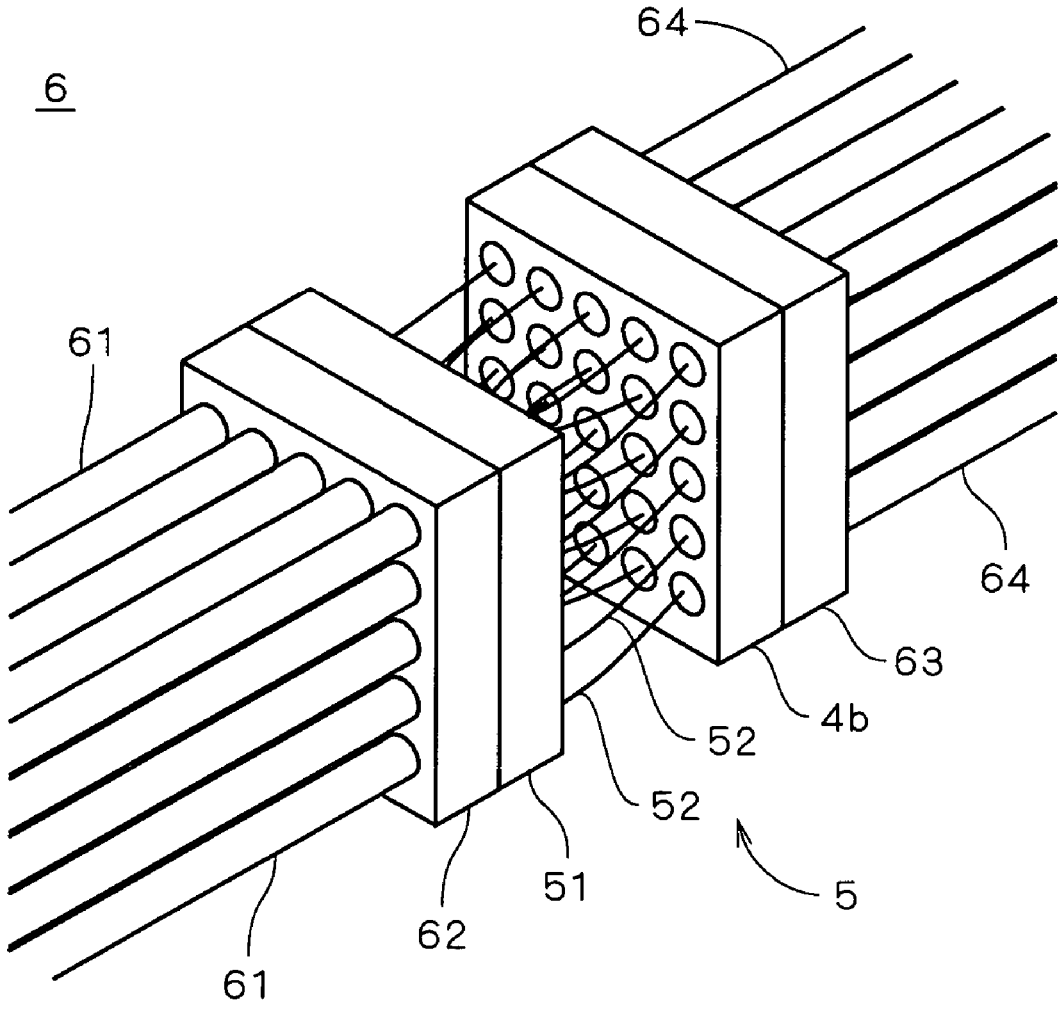
FIG. 16 is a view showing a construction of an optical transmission line comprising an optical amplifier.

FIG. 16 is a view showing a construction of an optical transmission line 6 which comprises an optical unit array 4*b* having almost the same constitution as that of the optical unit array 4 of FIG. 12. The optical transmission line 6 comprises an optical amplifier 5, a plurality of optical fibers 61 and 64 and connectors 62 and 63 onto which the optical fibers 61 and 64 are two-dimensionally arranged and connected.

The optical amplifier 5 comprises a photodiode array (hereinafter, referred to as "PD array") 51 having a plurality of photodiodes (hereinafter, referred to as "PDs"), the optical unit array 4*b* having a plurality of above-discussed light source modules 1 and wires 52 connecting the PDs to the corresponding light source modules 1. The optical unit array 4*b* has the same constitution as that of the optical unit array 4 shown in FIG. 12 except that five optical units in each of which five light source modules 1 are aligned are vertically arranged. On the connectors 62 and 63, twenty-five optical fibers 61 and twenty-five optical fibers 64 are arranged in matrix of 5×5 with high precision (with error of several μm), respectively.

In the optical transmission line 6, light signals transmitted through a plurality of optical fibers 61 are inputted to the PD array 51 through the connector 62, converted therein into electrical signals and then transmitted out to the optical unit array 4*b* through the wires 52. In the optical unit array 4*b*, the received electrical signals are converted into the light signals whose intensity of light is amplified, and the light signals are transmitted to the optical fibers 64 through the connector 63.

In the optical amplifier 5, since a plurality of light source modules 1 are arranged with high precision so that a plurality of light signals (light beams) should be emitted at predetermined outgoing angles from predetermined outgoing positions in the optical unit array 4*b*, it is possible to send out the amplified light signals with high accuracy even to the optical fibers 64 each of which has a core for receiving the light signal, whose diameter is several μm.

Though the preferred embodiment of the present invention has been discussed above, the present invention is not limited to the above-discussed preferred embodiment, but allows various variations. For example, the light source of the light source module 1 is not limited to the semiconductor laser 11 but other light emitting elements such as a light emitting diode may be used as the light source, and the light to be emitted is not limited to a beam light. As the collimator lens 123 provided in the lens part 12, a ball lens, a drum lens or the like may be used. Instead of the collimator lens 123, other lens may be provided in the lens part 12. The platform 13 may be formed of other materials such as heavy metals, only if the required thermal conductivity is satisfied.

Though it is preferable that the pressed part which is directly pressed from the outside in pressing the directioning surface 131 against the directioning plate 23 should be the module electrode 14 in the light source module 1 in terms of simplification of the structure for supplying power to the semiconductor laser 11, any member other than the module electrode 14 may be used if power can be supplied to the semiconductor laser 11 by other methods.

The directioning surface 131 may not be absolutely perpendicular to the optical axis 121 of the lens part 12 but has only to be substantially perpendicular thereto only if a predetermined outgoing angle of a light beam can be determined. The directioning surface 131 may be provided all around the lens part 12 or provided at a plurality of portions around the lens part 12.

Though it is preferable that the positioning surface should be the lens-part outer surface 122*a* in terms of simplification of the structure of the light source module 1, if other projection stands on the light source module 1, the position of the light source module 1 may be determined by inserting an outer surface of the projection into other exclusive positioning opening as the positioning surface.

In the optical unit 2, a plurality of light source modules 1 may be provided in a staggered arrangement along a line connecting the first pin 213 and the second pin 214.

In the optical unit 2, the method for positioning of a plurality of light source modules 1 relative to the first pin 213 and the second pin 214 is not limited to fitting of the first pin 213 and the second pin 214 into the two pin openings 223 of the aligning plate 22, but the positioning may be performed by bringing recessed portions provided on both ends of the aligning plate 22 (e.g., U-shaped openings) into contact with the first pin 213 and the second pin 214.

In the optical unit 2, the number of light source modules 1 to be used is not limited to the number shown in the above preferred embodiment but an appropriate number of light source modules 1 for the purpose are used. Further, in the optical unit 2, instead of the light source modules 1, other optical device elements such as lens modules or light receiving modules may be provided.

The electric probe 24 of the optical unit 2 may have a structure with an elastic body other than the spring provided inside the probe body 242 only if the electric probe 24 can be elastically contracted in a longitudinal direction, or may be a member formed of a material having an appropriate elasticity. Though it is preferable to provide a structure in which the light source module 1 is supplied with power by the electric probe 24 which is a member for pressing the light source module 1 in terms of simplification of the structure for supplying power to the light source module 1, a member for pressing the light source module 1 and a member for supplying the light source module 1 with power may be different. In the pressing part 30, the electric probe 24 and the PWB 27 may be formed as a unit body.

In the optical unit 2, if the reference surface 212 and the aligning plate 22 have flatness equal to that of the arrangement surface 232 and there is no trouble in attachment and detachment of the light source module 1 to/from the optical unit 2, the directioning plate 23 may be omitted.

In the holding part 40 of the optical unit array 4, instead of the first comb-teeth member 41 and the second comb-teeth member 42, one comb-teeth member comprising a first comb-teeth part having a plurality of grooves 411 and a second comb-teeth part having a plurality of grooves 421 disposed opposite to the first comb-teeth part may be provided. The first comb-teeth member 41 and the second comb-teeth member 42 may hold a plurality of optical units 2 from the inside in the arrangement direction of the light source modules 1.

The heatsinks 28 in the optical unit array 4 may be attached to a plurality of optical units 2 after the optical units 2 are attached to the holding part 40 and the optical unit array 4 is fabricated, and in this case, one large-sized heatsink which can respond to a plurality of optical units 2 may be attached.

The pattern writing apparatus comprising the optical unit array 4*a* is not limited to the image recording apparatus 3 but may be used, for example, as an apparatus for writing pattern on a semiconductor substrate, a glass substrate for a flat panel display or the like.

While the invention has been shown and described in detail, the foregoing description is in all aspects illustrative and not restrictive. It is therefore understood that numerous modifications and variations can be devised without departing from the scope of the invention.

What is claimed is:

1. An optical unit array, comprising:

a plurality of optical units each having a plurality of optical device elements arranged along a first direction, for emitting a light beam having directivity;

a holding part for holding said plurality of optical units to be arranged in a second direction substantially perpendicular to said first direction; and at least one plane with which said plurality of optical units are in contact, wherein each of said plurality of optical units comprises:

a directioning plate having a flat arrangement surface parallel to said first direction and said second direction, on which said plurality of optical device elements are arranged, being in contact with said at least one plane;

a unit base having a reference surface parallel to said arrangement surface and a first protruding portion and a second protruding portion which are disposed away from each other at a predetermined spacing in said first direction, protruding in a direction perpendicular to said reference surface, and an aligning plate located between said reference surface and a surface opposite to said arrangement surface of said directioning plate, having two openings into which said first protruding portion and said second protruding portion are inserted, said plurality of optical device elements being attached to said aligning plate through said directioning plate, said aligning plate being used for determining positions of said plurality of optical device elements in said first direction and said second direction relative to said first protruding portion and said second protruding portion by fitting said first protruding portion and said second protruding portion into said two openings, and each of said plurality of optical device elements comprises a directioning surface used for determining an outgoing direction of a light beam by coming into contact with said arrangement surface.

2. The optical unit array according to claim 1, wherein each of said plurality of optical units further comprises a pressing part which sandwiches said plurality of optical device elements with said arrangement surface to press said plurality of optical device elements towards said arrangement surface.

3. The optical unit array according to claim 2, wherein said pressing part is connected to a power source, and said pressing part comprises a plurality of electric terminals for supplying power to said plurality of optical device elements, respectively, provided at portions which are in contact with said plurality of optical device elements.

4. The optical unit array according to claim 3, wherein said plurality of electric terminals are a plurality of electric probes, and said pressing part further comprises a printed wiring board with which said plurality of electric probes are in contact.

5. The optical unit array according to claim 4, wherein each of said plurality of electric probes has a probe pin, an elastic body, and a probe body, and said probe pin moves towards inside of said probe body as said elastic body contracts when said each of said plurality of electric probes is pressed between said printed wiring board and said plurality of optical device elements.

6. The optical unit array according to claim 3, wherein said arrangement surface is connected to said power source, and said directioning surface of each of said plurality of optical device elements is an electric terminal.

7. The optical unit array according to claim 3, wherein said plurality of optical units are electrically insulated from one another.

8. The optical unit array according to claim 1, wherein said plurality of optical device elements each comprises a projection, said aligning plate comprises a plurality of positioning openings into which a plurality of projections of said plurality of optical device elements are inserted, respectively, said directioning plate comprises a plurality of other openings formed at positions corresponding to said plurality of positioning openings and said plurality of projections are inserted into said plurality of other openings, respectively, and a position of each of said plurality of optical device elements in an optical unit is determined by fitting said projection into a corresponding opening out of said plurality of positioning openings.

9. The optical unit array according to claim 8, wherein said projection is a lens part which comprises an outer surface which is inserted into said corresponding opening as a positioning surface used for determining a position of an optical axis of said optical unit by fining.

10. The optical unit array according to claim 1, wherein said aligning plate is a thin film.

11. The optical unit array according to claim 1, wherein said holding part comprises a first comb-teeth part having a plurality of grooves for holding a plurality of first protruding portions of said plurality of optical units from outside or inside in said first direction to determine positions of said plurality of first protruding portions; and a second comb-teeth part having a plurality of grooves for holding a plurality of second protruding portions of said plurality of optical units from outside or inside in said first direction to determine positions of said plurality of second protruding portions.

12. A pattern writing apparatus for writing a pattern on an object, comprising:

an optical unit array;

an optical system for guiding a plurality of light beams emitted from said optical unit array; and a scanning mechanism for scanning irradiation positions of sad plurality of light beams on said object, wherein said optical unit array comprises a plurality of optical units each having a plurality of optical device elements arranged along a first direction, for emitting a light beam having directivity;

a holding part for holding said plurality of optical units to be arranged in a second direction substantially perpendicular to said first direction; and at least one plane with which said plurality of optical units are in contact, wherein each of said plurality of optical units comprises:

a directioning plate having a flat arrangement surface parallel to said first direction and said second direction, on which said plurality of optical device elements are arranged, being in contact with said at least one plane;

a unit base having a reference surface parallel to said arrangement surface and a first protruding portion and a second protruding portion which are disposed away from each other at a predetermined spacing in said first direction, protruding in a direction perpendicular to said reference surface, and an aligning plate located between said reference surface and a surface opposite to said arrangement surface of said directioning plate, having two openings into which said first protruding portion and said second protruding portion are inserted, said plurality of optical device elements being attached to said aligning plate through said directioning plate, said aligning plate being used for determining positions of said plurality of optical device elements in said first direction and said second direction relative to said first protruding portion and said second protruding portion by fitting said first protruding portion and said second protruding portion into said two openings, and each of said plurality of optical device elements comprises:

a directioning surface used for determining an outgoing direction of a light beam by coming into contact with said arrangement surface.

13. The pattern writing apparatus according to claim 12, wherein each of said plurality of optical units further comprises a pressing part which sandwiches said plurality of optical device elements with said arrangement surface to press said plurality of optical device elements towards said arrangement surface.

14. The pattern writing apparatus according to claim 13, wherein said pressing part is connected to a power source, and said pressing part comprises a plurality of electric terminals for supplying power to said plurality of optical device elements, respectively, provided at portions which are in contact with said plurality of optical device elements.

15. The pattern writing apparatus according to claim 14, herein said plurality of electric terminals are a plurality of electric probes, and said pressing part further comprises a printed wiring board with which said plurality of electric probes are in contact.

16. The pattern writing apparatus according to claim 15, wherein each of said plurality of electric probes has a probe pin, an elastic body, and a probe body, and said probe pin moves towards inside of said probe body as said elastic body contracts when said each of said plurality of electric probes is pressed between said printed wiring board and said plurality of optical device elements.

17. The pattern writing apparatus according to claim 14, wherein said arrangement surface is connected to said power source, and said directioning surface of each of said plurality of optical device elements is an electric terminal.

18. The pattern writing apparatus according to claim 14, wherein said plurality of optical units are electrically insulated from one another.

19. The pattern writing apparatus according to claim 12, wherein said plurality of optical device elements each comprises a projection, said aligning plate comprises a plurality of positioning openings into which a plurality of projections of said plurality of optical device elements are inserted, respectively, said directioning plate comprises a plurality of other openings formed at positions corresponding to said plurality of positioning openings and said plurality of projections are inserted into said plurality of other openings, respectively, and a position of each of said plurality of optical device elements in an optical unit is determined by fitting said projection into a corresponding opening out of said plurality of positioning openings.

20. The pattern wiring apparatus according to claim 19, wherein said projection is a lens part which comprises an outer surface which is inserted into said corresponding opening as a positioning surface used for determining a position of an optical axis of said optical unit by fitting.

21. The pattern wiring apparatus according to claim 12, wherein said aligning plate is a thin film.

22. The optical unit array according to claim 12, wherein said holding part comprises a first comb-teeth part having a plurality of grooves for holding a plurality of first protruding portions of said plurality of optical units from outside or inside in said first direction to determine positions of said plurality of first protruding portions; and a second comb-teeth part having a plurality of grooves for holding a plurality of second protruding portions of said plurality of optical units from outside or inside in said first direction to determine positions of said plurality of second protruding portions.

* * * * *